United States Patent [19]

Van Amburg

[11] 4,006,695

[45] Feb. 8, 1977

[54] APPARATUS FOR APPLYING SLIDE FASTENER CHAIN TO TUBULAR GARMENT

[75] Inventor: William Frederick Van Amburg, Meadville, Pa.

[73] Assignee: Textron, Inc., R.I.

[22] Filed: May 30, 1975

[21] Appl. No.: 582,161

[52] U.S. Cl. ..... 112/104; 112/163

[51] Int. Cl.[2] ..... D05B 3/12

[58] Field of Search ..... 112/104, 136, 151, 163, 112/235, 265, 260, 63, 178, 121.15

[56] References Cited

UNITED STATES PATENTS

| | | | |
|---|---|---|---|
| 765,884 | 7/1904 | Dormandy | 112/151 |
| 1,796,111 | 3/1931 | Lewis | 112/136 |
| 1,872,769 | 8/1932 | Lewis | 112/136 |
| 2,329,991 | 9/1943 | Kellum | 112/136 |
| 2,947,271 | 8/1960 | Perla | 112/260 |
| 3,547,059 | 12/1970 | Dolney et al. | 112/151 |
| 3,669,049 | 6/1972 | Marforio | 112/235 X |
| 3,680,510 | 8/1972 | Ebata | 112/235 |
| 3,710,745 | 1/1973 | Yoshikawa | 112/265 |

*Primary Examiner*—Thomas F. Callaghan
*Assistant Examiner*—Moshe I. Cohen

[57] ABSTRACT

A pair of stringers are stitched to opposite edge portions of a seam opening in a tubular garment while the portion of the tubular garment opposite the seam opening is held in front of the stitching station to prevent stitching the front and back or opposite side portions of the garment together.

2 Claims, 3 Drawing Figures

FIG. 1
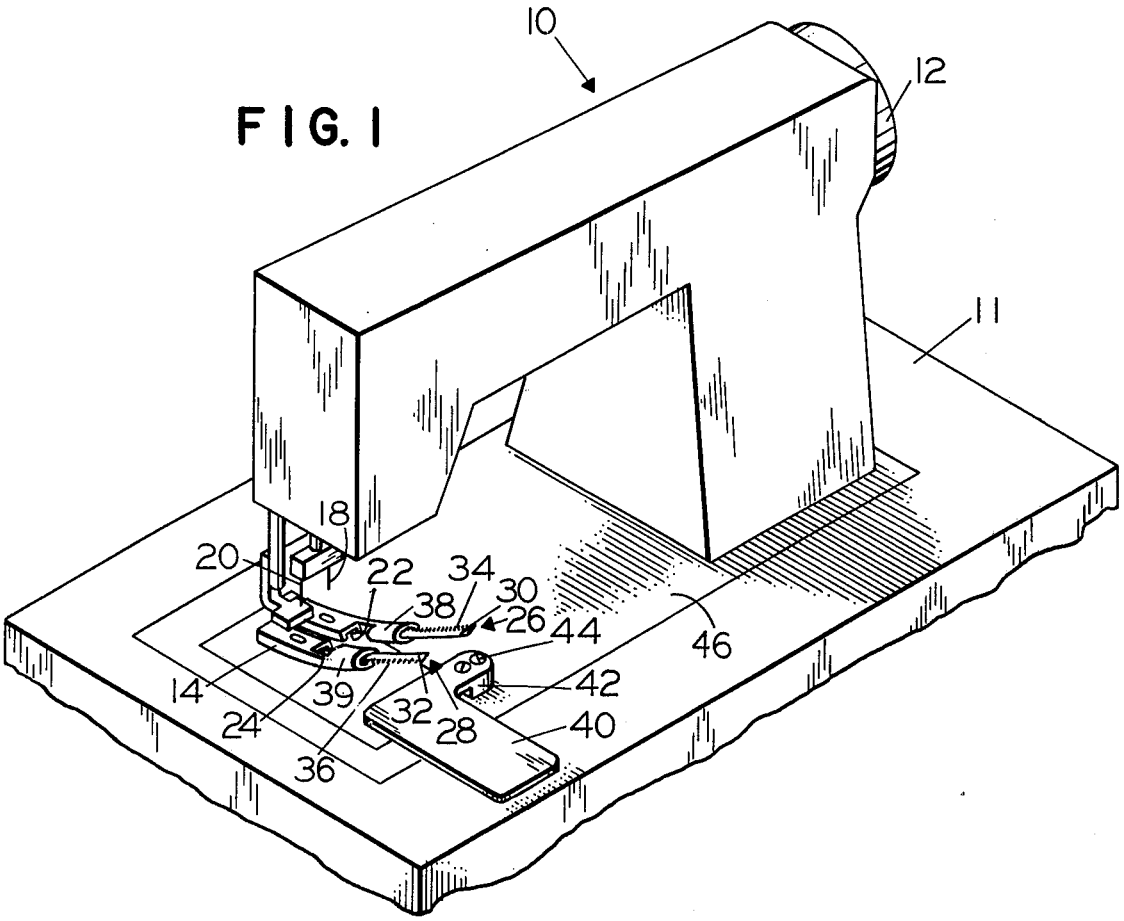
FIG. 2
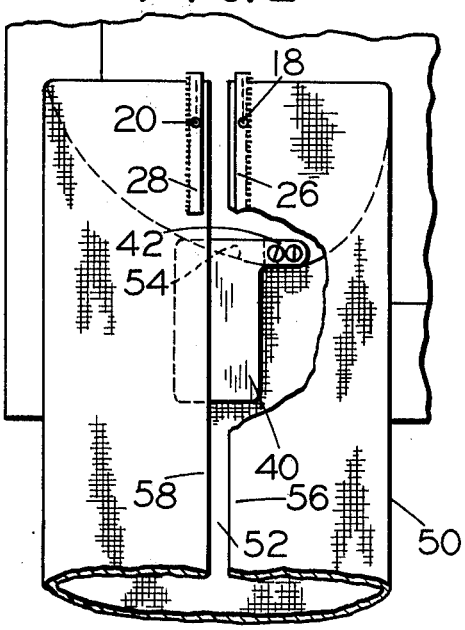
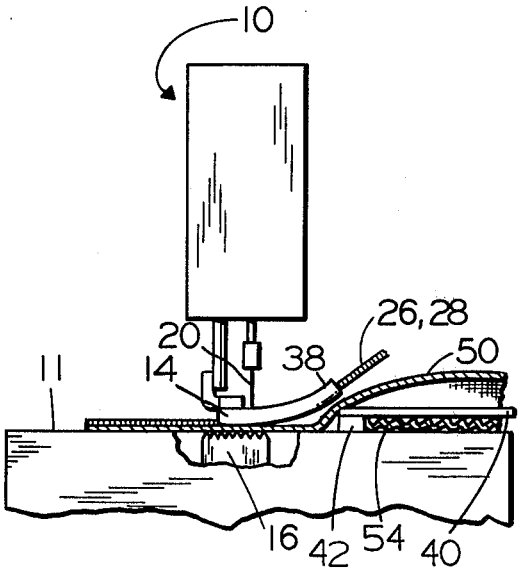
FIG. 3

APPARATUS FOR APPLYING SLIDE FASTENER CHAIN TO TUBULAR GARMENT

BACKGROUND OF THE INVENTION

1. Field of the Invention

This application relates to the application of slide fastener chains to seams and particularly to seams in a tubular garment.

2. Description of the Prior Art

Fastener chains are conventionally secured to open seams in tubular garments by sequentially sewing each stringer to a respective side edge portion of the seam. U.S. Pat. Nos. 3,318,273, 3,680,510, 3,703,148 and 3,710,745 disclose various apparatus and methods of sewing slide fasteners to seams including the utilization of a double needle sewing machine to simultaneously sew opposite stringers to the respective edge portions of the seam; however, such techniques of simultaneously sewing both stringers to opposite sides of the opening have not been applied to tubular garments since the portion of the tubular garment opposite to the seam opening is easily fed beneath the double sewing needles along with the fastener chain and edge portions of the seam opening to be stitched together.

SUMMARY OF THE INVENTION

The invention is summarized in that a method of sewing a pair of stringers for a slide fastener to opposite edge portions of a longitudinal seam opening in a tubular garment includes the steps of simultaneously advancing the pair of stringers in overlapping relationship with the respective opposite edge portions of the seam through a sewing station, simultaneously stitching the pair of stringers to the respective opposite edge portions of the seam as the stringers and seam edge portions are advanced through the sewing station, and holding the portion of the garment opposite the seam opening in front of the sewing station as the stringers and the seam edge portions are advanced through the sewing station.

An object of the invention is to provide a method and apparatus of simultaneously sewing the opposite stringers of a fastener chain to the side edge portions of a seam opening in a tubular garment.

Another object of the invention is to eliminate the necessity of sewing each stringer in a separate step to the opposite edge portions of a seam in a tubular garment.

It is also an object of the invention to provide a method and apparatus wherein the portion of the tubular garment opposite to the seam is held as the slide fastener chain is stitched to the seam opening of a garment.

One advantage of the invention is that a plate utilized for holding a portion of a tubular garment may also be utilized as a guide for the edge portions of a seam opening in the garment.

Other objects and advantages of the invention will become apparent from the following description when taken in conjunction with the accompanying drawings.

BRIEF DESCRIPTION OF THE DRAWINGS

FIG. 1 is a perspective view of a sewing apparatus for stitching stringers to a seam opening in a tubular garment in accordance with the invention.

FIG. 2 is a top view of a portion of the apparatus of FIG. 1 illustrating the sewing of the stringers of a slide fastener to a seam opening in a tubular garment.

FIG. 3 is a side elevation view of the apparatus of FIG. 1.

DESCRIPTION OF THE PREFERRED EMBODIMENT

As illustrated in FIGS. 1, 2 and 3 an apparatus for sewing a slide fastener to the seam opening in a tubular garment in accordance with the invention includes a two-needle sewing machine, indicated generally at 10, mounted on the tabletop 11. The sewing machine 10 has motor driven means 12 located at one end thereof; and at a sewing station at the other end of the sewing machine 10, the machine 10 has a presser foot 14, a feed dog 16, and double stitch forming means including spaced needles 18 and 20. The presser foot 14 has grooves 22 and 24 to guide respective stringers 26 and 28 of a slide fastener chain beneath the respective sewing needles 18 and 20. The stringers 26 and 28 have respective tapes 30 and 32 and respective coupling elements 34 and 36 secured to edges of the tapes 30 and 32. Tubular guides 38 and 39 are mounted on the presser foot 14 and extend upward and in front of the sewing station and have suitable passageways for receiving and guiding the respective stringers 26 and 28.

A plate 40 has a post portion 42 mounted by screws 44 on a base 46 of the sewing machine 10. The post portion 42 supports the plate 40 in a position sufficiently above the base 46 of the sewing machine 10 and the tabletop 11 such that it will readily receive a garment portion underneath. The plate 40 is elongated with its longest dimension extending directly in alignment in front of the sewing station.

As illustrated in FIG. 2, a tubular garment 50 has a seam opening 52 and a garment portion 54 opposite to the seam opening 52. The tubular garment 50 may be formed from a single tubular cloth which has been slit, or from one or more cloth portions which have been sewn or stitched together to form a tubular garment with the seam opening 52. The opening 52 has opposite side edge portions 56 and 58.

In sewing the stringers 26 and 28 to the opposite edge portions 56 and 58 of the opening 52, the fastener chain stringers 26 and 28 (previously separated) are fed into the respective tubular guides 38 and 39 with the fastening elements 34 and 36 facing outward. Also, the tubular garment 50 is turned inside out and placed upon the tabletop 11 with the portion 54 of the garment opposite to the seam opening being inserted beneath the plate 40. The top edges of the edge portions 56 and 58 are inserted beneath the presser foot 14 along with the ends of the fastener stringers 26 and 28 in the grooves 22 and 24. Thereafter, the motor driven facilities 12 of the sewing machine 10 are operated to automatically operate the feed dog 16 to advance the edge portions 56 and 58 together with the tapes 30 and 32 simultaneously through the sewing station beneath the respective needles 18 and 20. The stitching means simultaneously stitches the tapes 30 and 32 to the respective seam edge portions 56 and 58. After a sufficient length of the stringers 26 and 28 is secured to the edge portions 56 and 58 the garment 50 may be finished in a conventional manner.

The plate 40 serves a dual function, namely, as a guide for the edge portions 56 and 58 of the seam opening 52 and as a holding means for the portion 54 of the garment 50. The elongated shape of the plate 40 operates as a guide for the operator in feeding the edge portions 56 and 58 beneath the needles 18 and 20 and presser foot 14 of the sewing machine 10. The portion 54 of the garment is caught by the post portion 42 of the plate and held from advancing into the sewing station beneath the needles 18 and 20; thus, stitching of the edge portions 56 and 58 to the portion 54 is prevented.

Since many modifications, variations, and changes in detail may be made to the described embodiment, it is intended that all matter in the foregoing description and the accompanying drawings be interpreted as illustrative and not in a limiting sense.

What is claimed is:

1. An apparatus for sewing a pair of stringers of a slide fastener chain to opposite edge portions of a seam opening in a tubular garment, the apparatus comprising a sewing machine having a tabletop, two stitching means, each including a needle, and means for feeding the pair of stringers together with the respective opposite edge portions of the seam opening in the garment simultaneously and in parallel through the respective stitching means, and a plate mounted in a raised horizontal position above and spaced from the tabletop in front of the two stitching means and the feeding means for engaging the portion of the tubular garment opposite the seam opening to prevent the engaged portion of the garment from being fed through the stitching means.

2. An apparatus as claimed in claim 1 wherein the plate is elongated and extends in a direction directly in alignment with the direction of operation of the sewing needles and the feeding means.

* * * * *